US005548915A

United States Patent [19]

Szarmach et al.

[11] Patent Number: 5,548,915

[45] Date of Patent: Aug. 27, 1996

[54] UNIVERSAL FIREARM DISABLING AND ALARM SYSTEM

[76] Inventors: Michael Szarmach, 1571 Hartford Turnpike, North Haven, Conn. 06473; Vincent Capodicci, 10 Mclean St., Stratford, Conn. 06497

[21] Appl. No.: 406,569

[22] Filed: Mar. 20, 1995

[51] Int. Cl.[6] ..... F41A 17/02

[52] U.S. Cl. ..... 42/70.11; 70/36; 70/38 R; 70/58; 70/DIG. 49; 340/542; 340/571

[58] Field of Search ..... 42/1.01, 70.11; 70/36, 37, 38 R, 38 A, 38 B, 38 C, 39, 57, 58, 233, DIG. 49; 116/8; 340/542, 571

[56] References Cited

U.S. PATENT DOCUMENTS

| | | | |
|---|---|---|---|
| 3,755,778 | 8/1973 | Kennedy et al. | 340/571 |
| 4,969,284 | 11/1990 | Healey et al. | 42/70.11 |
| 4,999,940 | 3/1991 | Madden | 42/70.11 |
| 5,001,854 | 3/1991 | Derman | 42/70.11 |
| 5,016,377 | 5/1991 | Gunning | 42/70.11 |
| 5,023,596 | 6/1991 | Sirman et al. | 340/571 |
| 5,044,106 | 9/1991 | Slocum | 42/70.11 |
| 5,162,778 | 11/1992 | Williamson | 340/571 |
| 5,233,777 | 8/1993 | Waterman, Jr. et al. | 42/70.11 |
| 5,367,811 | 11/1994 | Sansom | 42/70.11 |
| 5,404,735 | 4/1995 | Hsieh | 70/DIG. 49 |
| 5,446,988 | 9/1995 | Frederick, Jr. | 42/70.11 |

*Primary Examiner*—Stephen C. Bentley
*Attorney, Agent, or Firm*—Melvin I. Stoltz

[57] ABSTRACT

A universal firearm disabling and alarm signalling system is attained by providing a construction which is easily mounted to any firearm to prevent its unwanted use while also incorporating an automatic alarm signal which is immediately activated whenever the protected firearm is accessed by unauthorized persons. By employing the present invention, any movement of the firearm, or attempt to remove the disabling and alarm signalling system of the present invention from the firearm, causes an alarm signal to be continuously generated, preventing any unauthorized or unwanted use of the firearm. In the preferred embodiment, the universal, combined firearm disabling and alarm system of the present invention incorporates lock means cooperatively associated with the alarm signal generator which is quickly and easily mounted to any desired firearm for preventing unwanted use of the firearm and remains in secure locked interengagement therewith until disengaged by the user.

10 Claims, 4 Drawing Sheets

UNIVERSAL FIREARM DISABLING AND ALARM SYSTEM

TECHNICAL FIELD

This invention relates to firearm safety devices for preventing firearms from being employed when not desired and, more particularly, to such devices which also incorporate an alarm.

BACKGROUND ART

During recent years; many individuals who previously did not own firearms of any type have felt the need to protect themselves in their homes or businesses against increasing crime. As a result, these individuals have obtained a firearm of some type to assist in their protection. However, one of the principal difficulties with having a firearm in a home is the desire that the firearm be disabled in order to prevent its accidental use or discharge.

In addition to the ever-increasing purchase of firearms by individuals for protection, the use of firearms as a sport has also increased, causing various different types of firearms to be purchased in ever-increasing numbers. As a result, many homes have substantially more than one firearm located therein. In these situations, the secure locking of the firearm is extremely important to prevent its accidental or unwanted use and prevent access by children.

In view of the desirability and importance of disabling or locking a firearm for safety purposes, various safety devices have been developed. However, these prior art safety devices are generally incapable of satisfying the needs of firearm owners due to the wide variety of sizes and shapes of guns in use.

Most safety devices are constructed to block the barrel of the firearm to prevent its use or disable the movement of the trigger to prevent release of the hammer. However, these devices are generally constructed for a particular type of firearm and are incapable of being used for all types of firearms. As a result, numerous different systems must be obtained if each of the firearms owned by an individual is to be disabled or locked for safety reasons.

A further problem found with prior art systems is the difficulty often encountered in their use. Many prior art systems are complex, requiring various manipulations by the user in order to effectively lock the firearm to prevent its unwanted access or use. Consequently, these systems are often not used, due to the complexity in attempting to implement their use.

A further problem found with prior art safety devices, which has been incapable of being satisfactorily eliminated, is the ability of the safety devices to be easily broken by an individual seeking to gain access to an otherwise secured or locked firearm. In this regard, many prior art devices used to prevent access or use of a firearm can easily be broken by an individual having additional tools available to open the blocking device. As a result, the actual efficacy of these prior art systems to prevent firearms from being used by unwanted personnel is easily thwarted.

Therefore, it is a principal object of the present invention to provide a universal firearm disabling device which is capable of being quickly and easily installed in any firearm to prevent its unwanted use regardless of the type of firearm or its construction.

Another object of the present invention is to provide a universal firearm disabling device having the characteristic features described above which substantially prevents unwanted tampering of the firearm once the locking system has been activated.

Another object of the present invention is to provide a universally employable firearm disabling device having the characteristic features described above which incorporates alarm means automatically activated whenever the firearm is moved or is tampered with.

Another object of the present invention is to provide a universal firearm disabling system having the characteristic features described above which is incapable of being easily disassembled or removed while also causing unwanted activities to become immediately apparent.

Other and more specific objects will in part be obvious and will in part appear hereinafter.

SUMMARY OF THE INVENTION

By employing the present invention, all of the difficulties and drawbacks found in the prior art have been eliminated and a highly effective, universally applicable firearm disabling and alarm signalling system is realized. In accordance with the present invention, a unique construction provides a disabling system which is easily mountable to virtually any type of firearm, regardless of the make or construction of the firearm. In addition, the firearm disabling device of the present invention is also constructed with an alarm generating and monitoring system which continuously monitors the firearm and is automatically activated whenever the firearm is accessed by an unauthorized individual. As a result, anyone attempting to remove the disabling device, without authority of the owner, causes the alarm system to become activated, preventing the unauthorized individual from using or easily disabling the system.

In accordance with the present invention, a unique, universal integrated locking system and alarm monitoring construction is attained which can be employed with any firearm, whether the firearm comprises a hand gun, a rifle, etc. The universal integrated locking and alarm system is preferably contained in a central housing to which two elongated arm members are mounted. One arm member is fixedly mounted to the housing, while the second arm member is movably mounted to the housing for attaining varying alternate locked positions.

By employing the present invention, gun engaging ends of the system are mountable in either the barrel, muzzle, trigger, base, etc. of the firearm in the most convenient, easily attained, interengaged position. Once the desired position has been established, the first arm member is placed in engagement with the firearm and then the second arm member is mounted to the firearm in blocking engagement therewith securely affixed thereto by longitudinally advancing the movable arm relative to the housing, and locking the arm in its fully engaged position.

Once the disabling portion of the firearm locking and alarm system of the present invention is interengaged with the particular firearm, the system is activated by activation means, preferably comprising a key cooperatingly associated with the housing. Once activated, the disabling structure is securely affixed to the firearm and the alarm system is activated to prevent any unwanted tampering with the firearm.

Once activated, the alarm system is constructed to provide an extremely high decibel level, audible signal whenever the firearm is moved or tampered with. As a result, whenever any unauthorized person attempts to gain access to the firearm to which the universal locking and alarm system of the present invention has been mounted, the alarm will automatically be activated, either immediately informing the owner that the firearm has been accessed, while also preferably causing the unauthorized person to incur discomfort due to the decibel level of the alarm.

As is apparent from the foregoing, the universal, combined firearm disabling and alarm system of the present invention is constructed for being securable to any desired firearm in any desired blocking or disabling position. In addition, once secured in place, the alarm is easily activated assuring that no unauthorized use of movement of the firearm is attempted. As a result, the difficulties and drawbacks of the prior art systems are overcome.

The invention accordingly comprises a product possessing the features, properties and relation of components which will be exemplified in the product hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
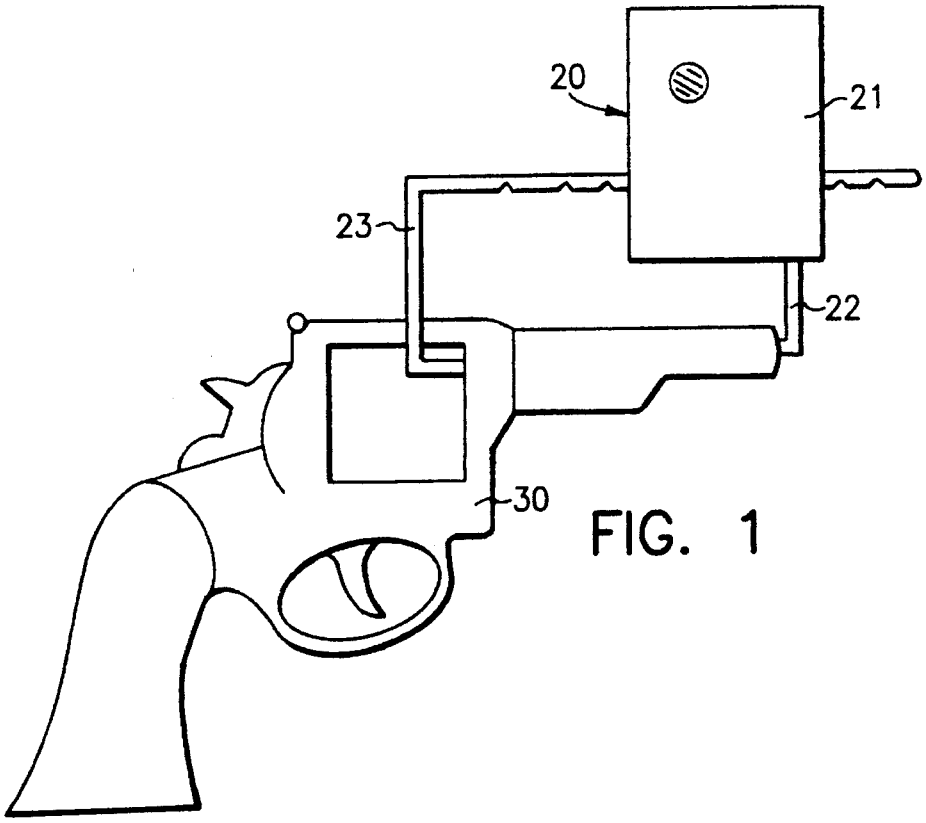
FIG. 1 is a side elevation view, depicting the universal, combined firearm disabling and alarm system of the present invention mounted in the barrel of a handgun.
Figure 2:
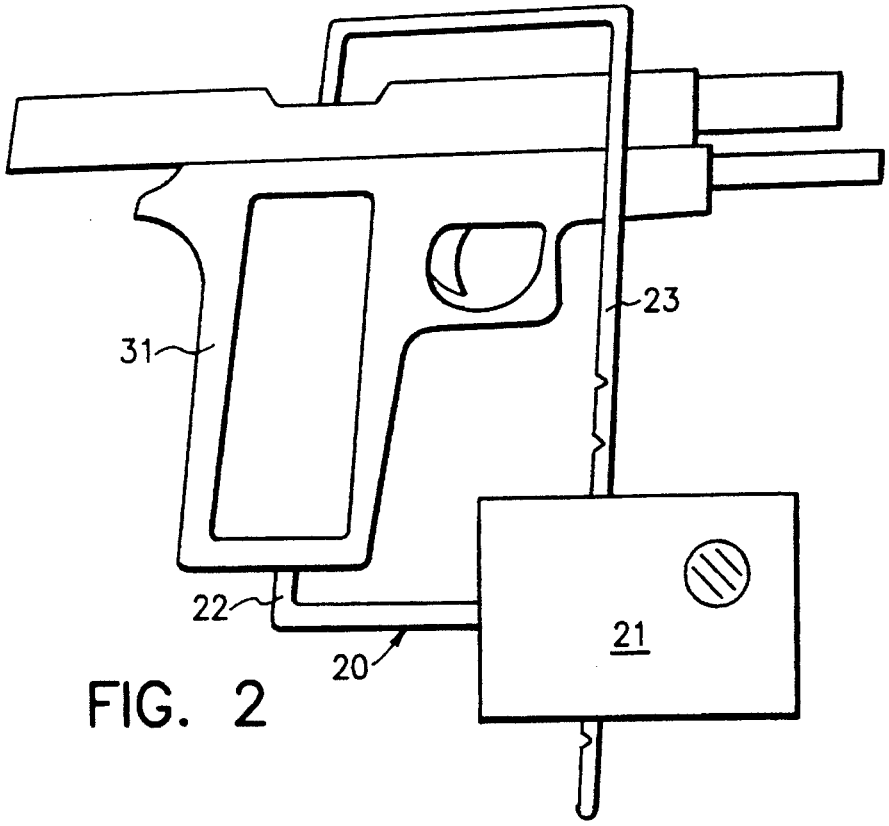
FIG. 2 is a side elevation view, depicting the universal, combined firearm disabling and alarm system of the present invention mounted in the clip and handle of a different handgun.
Figure 3:
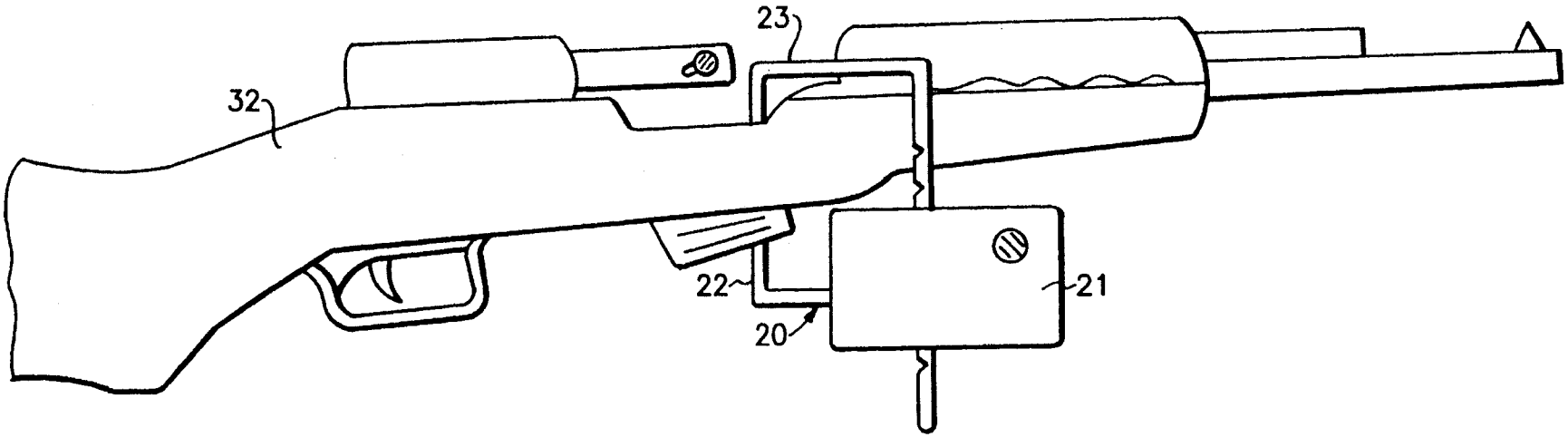
FIG. 3 is a side elevation view, partially broken away, depicting the universal, combined firearm disabling and alarm system of the present invention mounted in blocking relationship with the handle of a rifle.

By referring to FIGS. 1–3, the versatility of the universal, combined firearm disabling and alarm system 20 of the present invention becomes readily apparent. In these figures, disabling/alarm system 20 of this invention is shown employed on a variety of different firearms, namely hand guns and rifles and is shown mounted in different arrangements on the particular firearm. Regardless of the mounting method employed, the desired disabling function and the desired alarm function is provided in each instance.

In order to provide the desired disabling and alarm functions, system 20 comprises a housing 21, a fixed arm 22, and a movable or adjustable arm 23. As detailed below, the locking means and alarm means are retained in housing 21. By employing this construction, arms 22 and 23 are easily mounted in any desired lockingly engaged position with any desired firearm to secure the firearm and prevent its use, as well as providing alarm means for immediate activation whenever the firearm is accessed by an unauthorized person.

In FIG. 1, the universal, combined firearm disabling/alarm system 20 is shown in operation securely affixed to conventional handgun 30 which incorporates a revolving chamber within which the bullets are retained. With a handgun of this configuration, arms 22 and 23 of disabling/alarm system 20 are easily affixed in the barrel of the handgun to prevent use of the gun by unauthorized persons. As is more fully detailed below, disabling/alarm system 20 provides both the secure blocking function, wherein the handgun is incapable of being used, while also providing an immediate alarm signal if the handgun were to be moved or the disabling alarm system 20 were to be accessed in any way by an unauthorized individual.

In FIG. 2, disabling/alarm system 20 is depicted in locked interengagement with handgun 31. In FIG. 2, handgun 31 is depicted as a handgun which incorporates a clip for housing the bullets and which is inserted into the base of the handle of gun 31. In this embodiment, disabling/alarm system 20 is quickly and easily lockingly interengaged with handgun 31 by mounting arms 22 of disabling/alarm system 20 in the clip receiving base of gun 31 and mounting arm 23 in the hammer of gun 31. Once arms 22 and 23 are securely mounted and locked in their respective positions, handgun 31 is prevented from being used until disabling/alarm system 20 is removed.

In FIG. 3, the secure, locked interengagement of disabling/alarm system 20 of the present invention with rifle 32 is depicted. As shown therein, disabling/alarm system 20 is quickly and easily lockingly interengaged with rifle 32 by mounting arm 23 of system 20 in the bolt of rifle 32 and mounting arm 22 in the base of the stock or rifle 32. Once arms 22 and 23 are locked in their positions, use of rifle 32 is prevented.

As is apparent to one of ordinary skill in the art, disabling/alarm system 20 of the present invention can be employed to prevent the use of any type of firearm, as well as preventing the use of such firearm by being mounted thereto in a plurality of alternate positions and locations. For example, although FIG. 1 depicts the use of disabling/alarm system 20 of the present invention mounted in the barrel of handgun 30, the same arrangement can also be employed with handgun 31 of FIG. 2 and rifle 32 of FIG. 3.

In general, any desired firearm can effectively be disabled by employing system 20 of the present invention in blocking engagement with the barrel thereof. However, this mode of operation is not mandatory and, as shown in FIGS. 2 and 3, system 20 of the present invention can also be securely affixed to any desired firearm in a plurality of alternate positions and locations in order to secure the firearm from unwanted use and prevent the firearm from being accessed without an alarm signal being generated.

As is apparent from the foregoing discussion, disabling/alarm system 20 of the present invention can be mounted to any desired firearm in virtually any desired manner. The only requirement in employing alarm system 20 of the present invention is to assure that the firearm cannot be used without the removal of system 20. Based upon the foregoing, it is apparent to one of ordinary skill in the art that the alternate modes of use depicted in FIGS. 1–3 are presented for exemplary purposes only, and are not in any way intended to limit the scope of the present invention.

Figure 4:
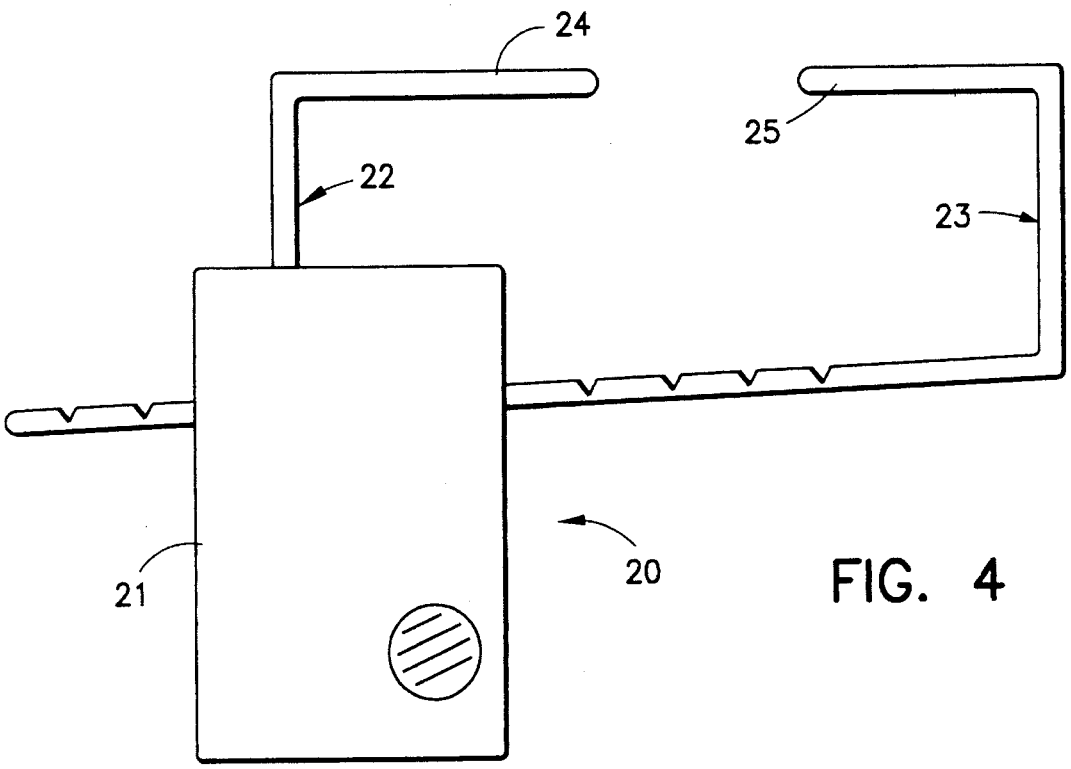
FIG. 4 is a top plan view depicting the universal, combined firearm disabling and alarm system of the present invention.
Figure 5:
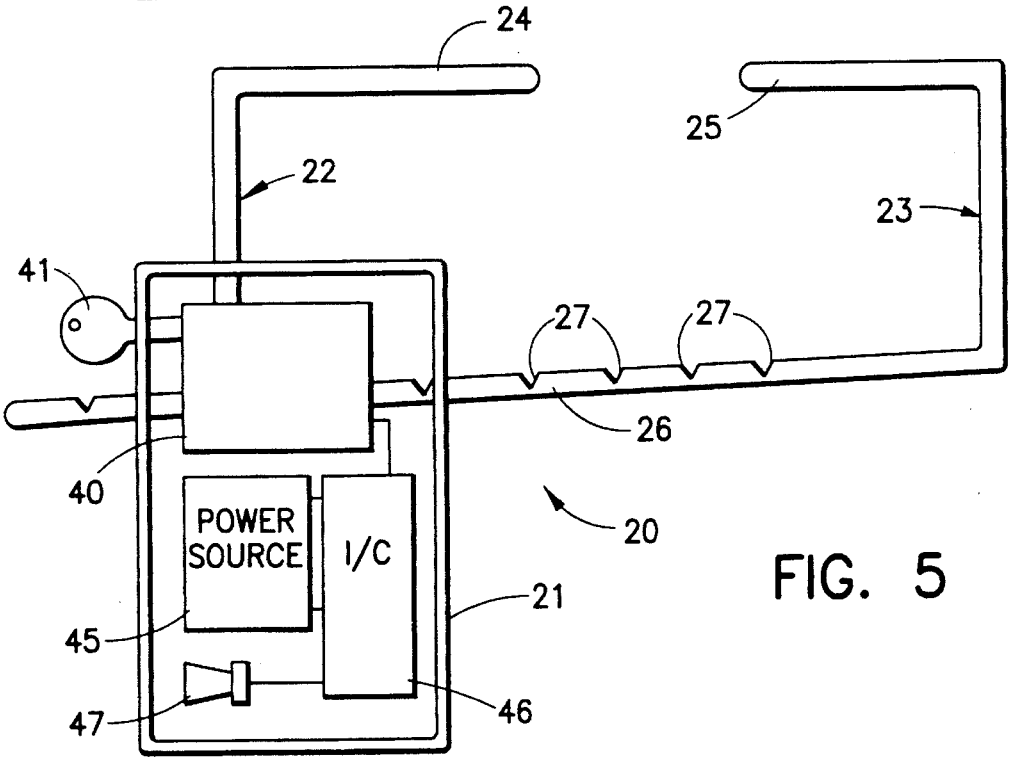
FIG. 5 is a top plan view of the universal, combined firearm disabling and alarm system of the present invention, depicted with the cover of the housing removed to display the internal components thereof.

By referring to FIGS. 4 and 5, along with the following detailed disclosure, the construction and operation of the preferred embodiment of the universal, combined firearm disabling and alarm system 20 can best be understood. As shown therein, as well as in FIGS. 1–3, disabling/alarm system 20 comprises a housing 21, a fixed arm member 22, and a movable arm member 23.

In the preferred embodiment, arm member 22 is generally fixedly mounted to housing 21, while arm member 23 is longitudinally movable relative to housing 21 in order to enable arm member 23 to be securely locked in any desired position. In this way, universal, combined firearm disabling and alarm system 20 of the present invention is capable of being quickly and easily securely mounted to any firearm in virtually any desired blocking location therewith in order to assure that the particular firearm is completely disabled and, thereby, incapable of being used by unwanted or unauthorized individuals.

In the preferred embodiment, arm 22 incorporates an elongated, substantially cylindrically shaped firearm engaging rod portion 24 at its distal end. Similarly, arm 23 incorporates an elongated, cylindrically shaped firearm engaging rod portion 25 forming the distal end thereof. In the preferred construction, cylindrically shaped firearm engaging rod portions 24 and 25 are positioned in juxtaposed, spaced, cooperating relationship with each other in order to provide the desired interlocking, interengagement with the firearm at the precisely desired location.

By constructing rod portions 24 and 25 with a small cylindrically shaped diameter, rod portions 24 and 25 are easily inserted into either the barrel, trigger, clip, hammer area, etc. of the firearm to be disabled. As a result, disabling/alarm system 20 of the present invention can be quickly and easily securely mounted to any desired firearm in order to assure the disabling of the firearm and the prevention of its use by any unauthorized individuals.

As shown in FIG. 5, housing 21 of disabling/alarm system 20 of the present invention incorporates therein lock means 40 to which arms 22 and 23 are cooperatively associated along with key 41. As discussed above, in the preferred embodiment, arm 22 is fixedly mounted at its proximal end to lock means 40, with arm 22 extending therefrom through the sidewall of housing 21 with elongated cylindrically shaped gun engaging rod portion 24 being spaced away from housing 21 and forming the distal end of arm 22.

In the preferred construction, movable arm 23 incorporates an elongated, locking portion 26 which is constructed for telescopic, sliding, locking interengagement with lock means 40. In order to provide the desired secure adjustable locked interengagement of portion 26 with lock means 40, portion 26 incorporates a plurality of notches 27 formed therein.

Using a generally conventional construction, elongated locking portion 26 is telescopically movable through lock means 40 in one direction which enables rod portion 25 of arm 23 to be advanced towards rod portion 24 of arm 22. However, if movement of locking portion 26 in the opposite direction is desired, such movement is prevented, unless key 41 of lock means 40 is employed and rotates to release the lock mechanism. In this way, the desired complete adjustability of firearm disabling/alarm system 20 is provided, allowing system 20 to be quickly and easily securely affixed to any desired firearm in the precisely desired location.

In using universal, combined firearm disabling/alarm system 20 of the present invention, key 41 is inserted in lock means 40 and rotated therein, enabling movable arm 23 to be adjusted into the precisely desired location. By rotating key 41 relative to lock means 40 in a release direction, locking portion 26 of arm 23 is released from lock means 40, enabling locking portion 26 to be longitudinally removed from lock means 40, with rod portion 25 being moved away from rod portion 24 of arm 22.

Once in this open position, elongated gun engaging rod portion 24 of arm 22 is placed in a first desired location in the particular firearm to be securely locked and disabled and, once rod portion 24 is in the desired position, rod portion 25 is advanced into engagement with the cooperating portion of the firearm to complete the secure locked interengagement thereof. By advancing rod portion 25 into the desired blocking position of the desired firearm, locking portion 26 of arm 23 is advanced relative to lock means 40, causing arm 23 to be securely locked relative thereto, once arm 23 has been advanced into its fully engaged position.

Once rod portions 24 and 25 are securely locked in the desired location, disabling the particular firearm to which system 20 has been mounted, key 41 is removed from lock means 40, thereby securely locking arms 22 and 23 in the precisely desired location, as well as activating the alarm system. Once in this position, the particular firearm is incapable of being used in any way, without causing activation of the alarm system.

In order to provide the desired alarm signal as an integral part of system 20 of the present invention, housing 21 of disabling/alarm system 20 incorporates a power source 45, an integrated circuit 46, and an alarm signal generator 47. As depicted in FIG. 5, power source 45 is interconnected with integrated circuit 46 in order to provide the desired power thereto for enabling integrated circuit 46 to monitor the firearm to which system 20 has been affixed. In addition, power means 45 also provides the power required to activate signal generator 47, whenever an alarm condition has occurred.

In the preferred embodiment, integrated circuit 46 comprises a preformed circuit to which lock means 40 is connected, along with power source 45. In addition, circuit 46 may incorporate its own alarm signal generator 47, such as speaker or amplifier or is connected to signal generator 47 as depicted in FIG. 5.

When integrated circuit 46 has been connected to the inputs detailed above, circuit 46 is operational and ready to be placed in an activated mode whenever key 41 is removed from lock means 40. Once an activation signal has been received from lock means 40, circuit 46 remains in a monitoring mode, providing an alarm signal whenever any type of movement or motion of disabling/alarm system 20 is sensed.

When system 20 has been securely mounted to a desired firearm and lockingly engaged therewith, the removal of key 41 simultaneously activates circuit 46 to prevent any individual from moving the firearm to which system 20 has been mounted. If an individual should attempt to move the particular firearm in any way, the motion will immediately be sensed by circuit 46, causing an alarm signal to be generated through signal generator/speaker 47. By constructing the alarm signal to be produced at a high decibel level, any individual in the area is immediately placed on notice that the alarm has been activated, while simultaneously causing discomfort to the individual who has improperly attempted to move or use the firearm to which system 20 has been mounted.

Figure 6:
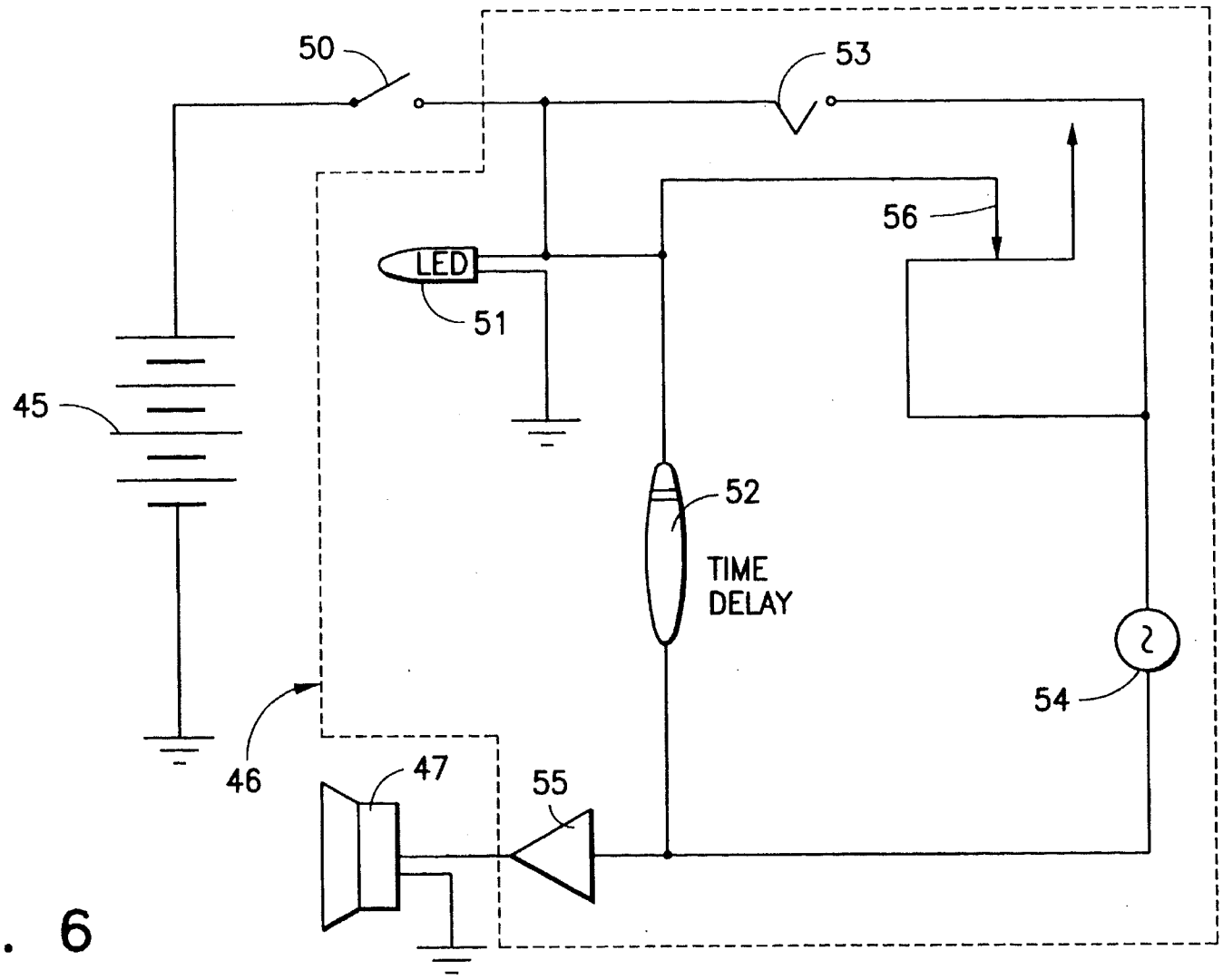
FIG. 6 is a schematic block diagram showing the circuitry incorporated into the combined firearm disabling and alarm system of this invention.

In FIG. 6, a schematic diagrammatic view of the preferred construction for the circuit employed to produce the desired alarm signal is provided. Although alternate constructions for providing an alarm signal of the nature desired may be incorporated in system 20 of the present invention, FIG. 6 provides the preferred construction for providing the desired alarm signal.

As shown in FIG. 6, power source 45 preferably comprises conventional batteries mounted in housing 21 and are connected to a switch 50. Switch 50 is formed as part of lock means 40 and is automatically activated whenever key 41 is removed from lock means 40 to lock and fully activate system 20 of the present invention.

Once activated, an LED 51 is preferably illuminated in order to inform the user that the entire system has been properly activated. In addition, circuit 46 of the present invention also incorporates an automatic time delay 52 which prevents any alarm signal from being generated for a predetermined length of time after switch 50 has been closed. In this way, the firearm, with disabling/alarm system 20 of the present invention fully engaged therewith, can be positioned by the user in any desired location without fear of premature activation of the alarm signal.

In order to provide the desired activation of the alarm signal whenever unwanted movement of the firearm is made, mercury switch 53 is incorporated into circuit 46. Once activated, mercury switch 53 remains in an open or OFF mode until movement of the firearm is sensed. If movement is sensed, mercury switch 53 is automatically closed, placing switch 53 into its ON mode which activates the production of the alarm signal.

The remaining components of circuit 46 comprise an oscillator 54, an amplifier 55, which is connected to signal generator/speaker 47, and a latching relay circuit 56. Latching relay 56 is incorporated into circuit 46 in order to assure that whenever mercury switch 53 is closed or activated, relay 56 latches circuit 46 in the activated mode, regardless of any subsequent movement of mercury switch 53 into an open position. Consequently, once mercury switch 53 has been activated by unauthorized movement of the firearm to which system 20 is mounted, the production of an alarm signal is achieved and remains activated regardless of any change in the condition of switch 53.

As is apparent from the foregoing detailed discussion, universal, combined firearm disabling/alarm system 20 of the present invention provides effective securely locked disabling engagement with any desired firearm in a plurality of alternate locations therewith, while simultaneously providing an alarm monitoring function which remains activated whenever system 20 is in secure, locked interengagement with a particular firearm. In addition, while in its activated mode, the circuitry retained in housing 21 of system 20 the firearm to which system 20 is affixed for any motion or movement and generates an immediate alarm signal if any unwanted or unauthorized access of the firearm is attempted.

Whenever an authorized individual wishes to employ the firearm to which system 20 has been mounted, the individual merely inserts key 41 through housing 21 and into lock means 40 and rotate key 41 to enable arm 23 to be disengaged from lock means 40 and be capable of removal from the firearm to which it has been secured. Simultaneously with the insertion and/or rotation of key 41 in lock means 40, circuit 46 is deactivated, enabling movement of system 20 and the firearm to which it is mounted without fear of having the alarm signal generated.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what we claim is new and desire to secure by Letters Patent is:

1. A universal, combined firearm disabling and alarm system constructed for being easily mounted to any firearm to prevent unauthorized use of the firearm, said system comprising A. lock means;

B. a first arm member having a. a proximal end fixedly mounted to the lock means, b. a distal end positioned remotely from the lock means and incorporating a first firearm engaging protrusion positionable in any desired firearm engaging location, and c. an intermediate portion 1. extending between the proximal end and the distal end, 2. comprising an overall length for positioning the first firearm engaging protrusion at a position remotely spaced from the lock means, and 3. extending from the lock means in a first direction;

C. a second arm member incorporating a. an elongated portion 1. constructed for axial adjustably movable locking interengagement with the lock means for being mounted in any desired position in secure, locked, affixed interengagement with the lock means, and 2. said axial, adjustable movement being in a second direction, substantially at right angles to the first direction, b. a second firearm engaging protrusion 1. formed at one end thereof for secure interengagement with a second desired portion of the firearm, and 2. positioned in juxtaposed, spaced, axial alignment with the first firearm engaging protrusion, cooperating with the first firearm engaging to prevent the use of the firearm and c. an intermediate portion 1. extending between the elongated portion and the second firearm engaging protrusion, and 2. comprising a length for positioning the second firearm engaging protrusion at a position remotely spaced from the lock means and in continuous, juxtaposed, spaced, axially aligned relationship with the first firearm engaging protrusion, regardless of the axial movement of the elongated portion relative to the lock means; and D. alarm means a. incorporating circuitry for monitoring the movement of the firearm and producing an alarm output whenever the firearm is moved by an unauthorized individual, and b. responsive to switch means for enabling and disabling the circuitry whenever desired by the user, whereby a universally applicable, combined firearm disabling and alarm system is attained which is quickly and easily mounted to any desired firearm in any desired disabling engagement therewith while also providing an alarm system which, when activated, prevents the useful movement of the firearm by any unauthorized persons.

2. The universal combined firearm disabling and alarm system defined in claim 1, wherein the first firearm engaging portion of the first arm member and the second firearm engaging portion of the second arm member are further defined as being constructed for cooperating, aligned, engagement with any desired portions of a firearm in cooperating firearm blocking relationship to prevent use or discharge of the firearm.

3. The universal combined firearm disabling and alarm system defined in claim 2, wherein said system further comprises E. a housing constructed for peripherally surrounding and securely retaining the lock means and the circuitry, assuring trouble-free, continuous operation of the firearm disabling and alarm system of the present invention without access thereto.

4. The universal combined firearm disabling and alarm system defined in claim 3, wherein said alarm means further comprises an alarm generator/speaker interconnected with the circuitry for receiving an activation signal and producing a high decibel alarm signal in response thereto, whenever activated.

5. The universal combined firearm disabling and alarm system defined in claim 4, wherein said circuitry is further defined as comprising an LED formed as part of the circuitry for indicating the activation of the alarm signal when in use.

6. The universal combined firearm disabling and alarm system defined in claim 5, wherein said lock means is further defined as comprising a key activation assembly cooperatively associated therewith for enabling the user to securely lock the movably adjustable second arm member in any desired position and activate the alarm system when the firearm has been disabled, as well as enabling the user to disengage the second arm member from locked, blocking interengagement with the firearm whenever desired and disable the alarm system when so desired.

7. The universal combined firearm disabling and alarm system defined in claim 6, wherein said circuit further comprises delay means formed therein for enabling the user to activate the alarm system and place the firearm wherever desired without having the alarm signal activated by movement thereof.

8. The universal combined firearm disabling and alarm system defined in claim 7, wherein said system further comprises a self-contained power supply retained in the housing for powering the circuitry and alarm means.

9. The universal combined firearm disabling and alarm system defined in claim 8, wherein said circuitry is further defined as comprising a mercury switch for causing the alarm system to be activated in response to unauthorized movement of the firearm and/or the firearm disabling and alarm system.

10. The universal combined firearm disabling and alarm system defined in claim 9, wherein said circuitry further comprises a latching relay connected to said mercury switch for assuring the continuous production of an alarm signal whenever said mercury switch has been activated, regardless of subsequent movement of said mercury switch.

* * * * *